United States Patent [19]

Lippincott, Sr.

[11] 4,106,136

[45] Aug. 15, 1978

[54] TOILET FLUSH FLOW ACCELERATOR

[76] Inventor: Richard L. Lippincott, Sr., 22122 Wood Island, Huntington Beach, Calif. 92646

[21] Appl. No.: 799,514

[22] Filed: May 23, 1977

[51] Int. Cl.[2] ..... E03D 1/06

[52] U.S. Cl. ..... 4/368; 4/378; 4/382; 4/387; 4/393; 4/415

[58] Field of Search ..... 4/67 A, 57 R, 67 R, 4/34, 37, 57 P, 1; 138/39

[56] References Cited

U.S. PATENT DOCUMENTS

| | | | |
|---|---|---|---|
| 3,636,983 | 1/1972 | Keyser | 138/39 |
| 3,643,431 | 2/1972 | Jamieson | 138/39 |
| 3,839,747 | 10/1974 | Clark | 4/67 A |
| 3,939,507 | 2/1976 | Clark | 4/67 A |

*Primary Examiner*—Henry K. Artis
*Attorney, Agent, or Firm*—William W. Haefliger

[57] ABSTRACT

A device usable in a toilet flush tank having a bottom wall opening comprises:

(a) a tubular body adjustably located in drain communication with said opening and having an inlet spaced above the level of said opening so that only tank water above the level of said inlet will flow downward through said body during the toilet flush cycle, (b) the body containing a venturi to accelerate said flow.

7 Claims, 3 Drawing Figures

TOILET FLUSH FLOW ACCELERATOR

BACKGROUND OF THE INVENTION

This invention relates generally to saving of water in the use of toilets, and more particularly concerns apparatus to maintain near normal functioning of toilets during the flush cycle while achieving substantial water economies.

Recently the need to eliminate or reduce the wastage of water especially in domestic use, has become increasingly evident. One of the prime areas of potential water savings is the operation of toilets during the flush cycle. Efforts to achieve such savings have included placement of objects such as blocks, bricks or liquid filled bags in toilet water holding tanks; however, these can damage the operation of flushing mechanism, and the consequent reduction in fluid flow to the toilet bowl can result in incomplete flushing.

SUMMARY OF THE INVENTION

It is a major object of the present invention to provide apparatus which overcomes the above problems and difficulties, and at the same time achieves substantial water economies. Basically, the device cooperates with the bottom wall drain opening of the flush water holding tank, and comprises:

(a) a tubular body adjustably located in drain communication with said opening and having an inlet spaced above the level of said opening so that only tank water above the level of said inlet will flow downward through said body during the toilet flush cycle, (b) the body containing a venturi to accelerate said flow.

As will appear, a lower portion of the body is typically closely received in the bottom wall drain opening, and means is provided to adjustably clamp the body to a stand pipe in the tank whereby the vertical position of the tubular body and inlet, relative to the water in the tank, can be controlled. This in turn controls the amount of flush water release to the toilet bowl, each flushing cycle. In this regard, the venturi accelerates the flush water flow so as to compensate for loss of head or pressure, toward achieving a normal flush action.

Further, the body may contain ducting opening to the venturi for passing fluid such as air to the venturi for mixing with the draining water, increasing its volume and compensating for volume loss due to the tubular body usage. Other fluids may also be added via such ducting.

These and other objects and advantages of the invention, as well as the details of an illustrative embodiment, will be more fully understood from the following description and drawings, in which:

DRAWING DESCRIPTION

DETAiLED DESCRIPTION

Figure 1:
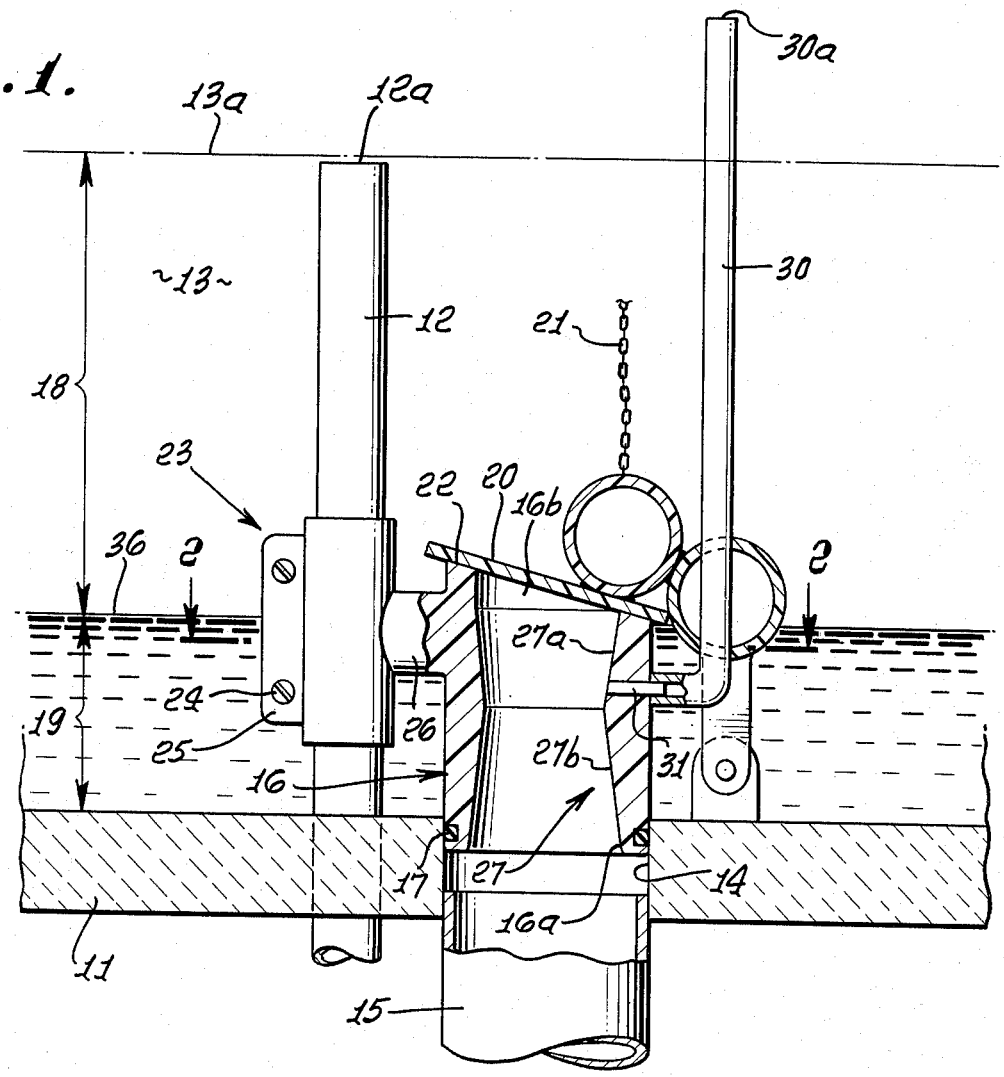
FIG. 1 is an elevation, partly in section, showing details of a device incorporating the invention.
Figure 3:
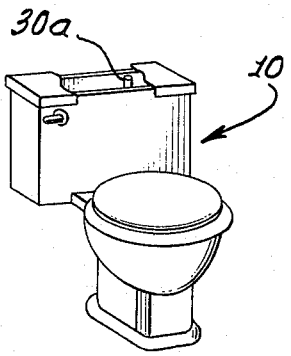
FIG. 3 is a perspective view of a toilet incorporating the FIGS. 1 and 2 device.
Figure 2:
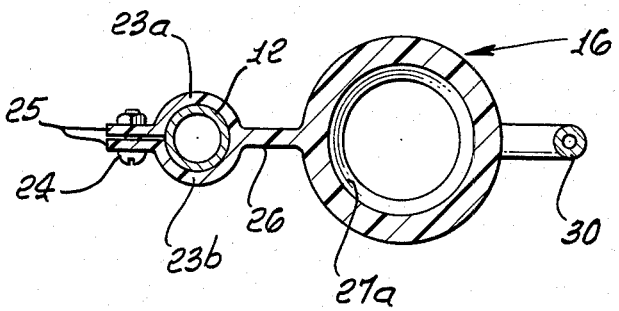
FIG. 2 is a horizontal section taken on lines 2—2 of FIG. 1.

In the drawings, a toilet flush water holding tank is shown at 10, the tank having a bottom wall 11. A conventional stand pipe 12 extends vertically to receive over-flow water from within the tank, the top opening of the stand pipe being indicated at 12*a* at the upper level 13*a* of the water 13 in the tank. The bottom wall 11 contains an outlet opening 14 for passing water to the toilet bowl during the flush cycle, and via pipe 15.

In accordance with the invention, a tubular body, as at 16, is located in drain communication with the opening 14. For example, a lower flange portion 16*a* of the body may be downwardly inserted to closely fit the opening 14, at selected level, and a suitable annular seal 17 may be provided, if desired, to seal off between the body and the opening. The tubular body has an inlet 16*a* spaced above the level of the opening 14 so that only the tank water above the level of inlet 16*a* will flow out through the body during the flush cycle. Such water depth is indicated at 18, and water that does not flow out, i.e. that is retained or saved, is indicated at 19. A flapper valve 20 extends over opening 16*b*, at an angle as shown, to be pulled upward as by a chain 21 so as to open the drain. The flapper valve normally seats at 22 on the body.

To stabilize the body, means may be provided for removably attaching the body to the stand pipe. Such means may advantageously include a clamp 23 integral with the body, and both being typically formed of molded plastic material. The clamp may include two sections 23*a* and 23*b* that releasably fit about the stand pipe and are attached via removable fasteners 24 projecting through flanges 25 integral with the two sections. Clamp 23 is laterally spaced from the body and connected thereto as by web 26. The clamp and body can be easily adjusted up or down to control the amount of flush water to be delivered to the toilet bowl.

In accordance with a further feature of the invention, the body 16 contains a venturi 27 acting to accelerate the downward flow through the body when the flapper valve is lifted. That venturi may be integral with the body and include oppositely tapered sections 27*a* and 27*b* which together extend throughout the major length of the body. Such acceleration is of advantage in that it compensates for the loss of tank water head or pressure due to the elevation of inlet 16*b* above outlet 14; accordingly, the elapsed time for flush water drainage from level 13*a* to level 36 (at the level of inlet 16*b*) is kept close to the normal elapsed time for drainage from level 13*a* to the bottom of the tank, as when tube 16 is not used.

In addition, the loss of total water volume delivered to the toilet bowl is compensated for by passing air to mix with the water draining through the tube. This function is performed by ducting including an air duct communicating with the venturi via the side of tube 16. For example, an air pipe 30 may be extended upward in the tank to provide an air inlet 30*a* above water level 13*a*; the pipe communicates at its lower end with a duct 31 through the side wall of the tube and opening to or near the throat of the venturi. Accordingly, air is drawn downwardly via the tube 30 and duct 31 to mix with water rushing through the venturi. Other fluids or chemicals may be added via the ducting, to the draining water, the siphoning action providing such addition.

As a result, the invention not only saves appreciable water during each flush cycle, but also compensates for the reduced pressure and volume of the flow in such manner as to produce a near normal flush fluid volume and flow rate, but using substantially less water.

Advantages of the invention include: increasing the velocity and volume of the reduced amount of water being delivered to the toilet bowl; height adjustability of the tubular and its inlet control the amount of water being delivered; the saving of water achieved, while maintaining simple and reliable operation; the fact that the flapper valve may be located anywhere; and the enablement of addition of other fluid or chemicals to the water draining via the venturi.

I claim:

1. In combination with a toilet flush tank having a bottom wall drain opening, the improvement comprising:

(a) a tubular body adjustably located in drain communication with said opening and having an inlet spaced above the level of said opening so that only tank water above the level of said inlet will flow downward through said body during the toilet flush cycle, (b) the body containing a venturi to accelerate said flow, the venturi located in direct vertically aligned communication with said drain opening, and below said inlet, (c) there being ducting in communication with said venturi via the side thereof for passing air to water flow through the venturi, the ducting having an inlet for air at atmospheric pressure.

2. The combination of claim 1 wherein a lower portion of said body is closely received in said drain opening.

3. The combination of claim 2 including means removably attaching said body to a stand pipe in said tank, whereby the vertical position of the body and said inlet relative to the water in the tank can be controlled.

4. The combination of claim 3 wherein said body consists of molded plastic material, and said means is integral with said body.

5. The combination of claim 1 wherein said ducting opens to the venturi proximate its throat for passing air to the water flow through the venturi, thereby to aerate the flow and effectively increase the volume thereof.

6. The combination of claim 5 including an air pipe extending upwardly in the tank and connected with said air duct, said pipe defining said air inlet at an upper region of the tank.

7. The combination of claim 5 wherein said ducting also includes an auxiliary duct for other fluid.

* * * * *